US007015938B2

(12) United States Patent
Kamimura et al.

(10) Patent No.: US 7,015,938 B2
(45) Date of Patent: Mar. 21, 2006

(54) CHARGING SYSTEM

(75) Inventors: Taisuke Kamimura, Nara (JP); Kiyoshi Toizumi, Nara (JP); Toshimitsu Gotoh, Yokohama (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/502,201

(22) PCT Filed: Jan. 20, 2003

(86) PCT No.: PCT/JP03/00439

§ 371 (c)(1),
(2), (4) Date: Jul. 22, 2004

(87) PCT Pub. No.: WO02/058130

PCT Pub. Date: Jul. 25, 2002

(65) Prior Publication Data

US 2005/0002694 A1 Jan. 6, 2005

(30) Foreign Application Priority Data

Jan. 25, 2002 (JP) ..... 2002-017583

(51) Int. Cl.

| | |
|---|---|
| ***B41J 2/385*** | (2006.01) |
| ***B41J 2/41*** | (2006.01) |
| ***G03G 13/04*** | (2006.01) |
| ***G03G 15/02*** | (2006.01) |

(52) U.S. Cl. ..... 347/140; 347/112; 347/129; 399/168

(58) Field of Classification Search ..... 399/130, 399/148, 153, 168, 169, 177; 347/112, 129, 347/132, 134, 135, 136, 140, 225, 255, 256
See application file for complete search history.

(56) References Cited

U.S. PATENT DOCUMENTS

| | | | | |
|---|---|---|---|---|
| 3,744,898 | A * | 7/1973 | Kurahashi et al. | 399/153 |
| 4,044,671 | A * | 8/1977 | Hou et al. | 347/129 X |
| 4,136,942 | A * | 1/1979 | Nakahata et al. | 399/153 |
| 4,290,690 | A * | 9/1981 | Noda et al. | 399/153 |
| 4,351,603 | A * | 9/1982 | Tagawa | 399/148 |
| 4,433,038 | A * | 2/1984 | Nishikawa | 399/153 X |
| 4,697,910 | A * | 10/1987 | Kasuya | 347/129 X |
| 4,851,865 | A * | 7/1989 | Ehara et al. | 347/140 |
| 4,959,665 | A * | 9/1990 | Saito et al. | 347/256 |
| 5,606,398 | A * | 2/1997 | Ender | 399/168 |
| 5,862,443 | A | 1/1999 | Ikegawa et al. | |
| 6,233,416 | B1 * | 5/2001 | Kinosita et al. | 399/153 X |

FOREIGN PATENT DOCUMENTS

| | | | |
|---|---|---|---|
| JP | 47-23600 | * | 6/1972 |
| JP | 8-76559 | | 3/1996 |
| JP | 10-232450 | | 9/1998 |
| JP | 2000-6470 A | | 1/2000 |

* cited by examiner

*Primary Examiner*—Sandra L. Brase
(74) *Attorney, Agent, or Firm*—Birch, Stewart, Kolasch & Birch, LLP

(57) ABSTRACT

Light emitted from an entire surface of a light source is passed selectively through a liquid crystal shutter. The shutter can be controlled to open/close on a pixel basis in response to image data and then selectively passed light is converted into light having a specified wavelength by a nonlinear optical element before impinging on a metal film. The metal film induces and emits its own electrons and forms an electrostatic latent image directly on a dielectric film.

13 Claims, 3 Drawing Sheets

CHARGING SYSTEM

TECHNICAL FIELD

The present invention relates to a charging device in an image forming apparatus of an electrophotographic system such as a copying machine, printer, and facsimile machine.

BACKGROUND ART

An image forming apparatus employing an electrophotographic system, such as a copying machine, printer, and facsimile machine, generally forms an electrostatic latent image in a method as described below. Namely, a corona charger, etc., provided on a photosensitive body uniformly charges an entire surface of the photosensitive body, and then a laser exposing device, etc., irradiates light on the photosensitive body in accordance with image data.

In a conventional image forming apparatus as described above, members for a charging step and members for an exposing step need to be separately located in the vicinity of the photosensitive body. Thus, it is difficult to miniaturize the apparatus. For this reason, techniques for unifying the charging step and the exposing step have been suggested. There is an ion flow recording technique known in the art. In this technique, ion flow generated by corona discharge is controlled on a pixel basis by control electrodes; and an electrostatic latent image is written directly onto a latent image carrying body.

However, the corona discharge utilizes an avalanche phenomenon under a high electric field, and is used in a so-called discharge flow area. Therefore the corona discharge generates ozone as a product of the discharge. Since it is not possible to continuously obtaining a discharge current (Id) stably if a wire electrode is used for the discharge, for example, the discharge current (Id) is generally stabilized in such a manner that a shield case is provided in the vicinity of the wire electrode, and a large current (Ic) is applied to the case. In such a system, the ozone is generated in large quantities. In other words, the system using the corona discharge phenomenon as described above can miniaturize the device, but cannot clear the problem of environmental pollution due to ozone. Consequently, it is difficult to put this system into practice.

In view of the foregoing problems, the present invention has an objective to provide a charging device which does not cause a problem of environmental pollution due to ozone.

DISCLOSURE OF INVENTION

In order to achieve the foregoing objective, a charging device of the present invention used in a developing apparatus which forms an electrostatic latent image on a latent image carrying body and develops an image using a developing agent is arranged so as to include light irradiating section irradiating light; and an electron emission section charging the latent image carrying body by, upon receiving the light irradiated from the light irradiating section, emitting electrons through a photoelectric effect.

With this arrangement, the electron emission section charges the latent image carrying body by the photoelectric effect. This can eliminate the need for corona discharge for charging the latent image carrying body. As a result, it is possible to perform the charging operation well without causing the problem of environmental pollution due to ozone.

For a fuller understanding of the nature and advantages of the invention, reference should be made to the ensuing detailed description taken in conjunction with the accompanying drawings.

BEST MODE FOR CARRYING OUT THE INVENTION

Figure 1:
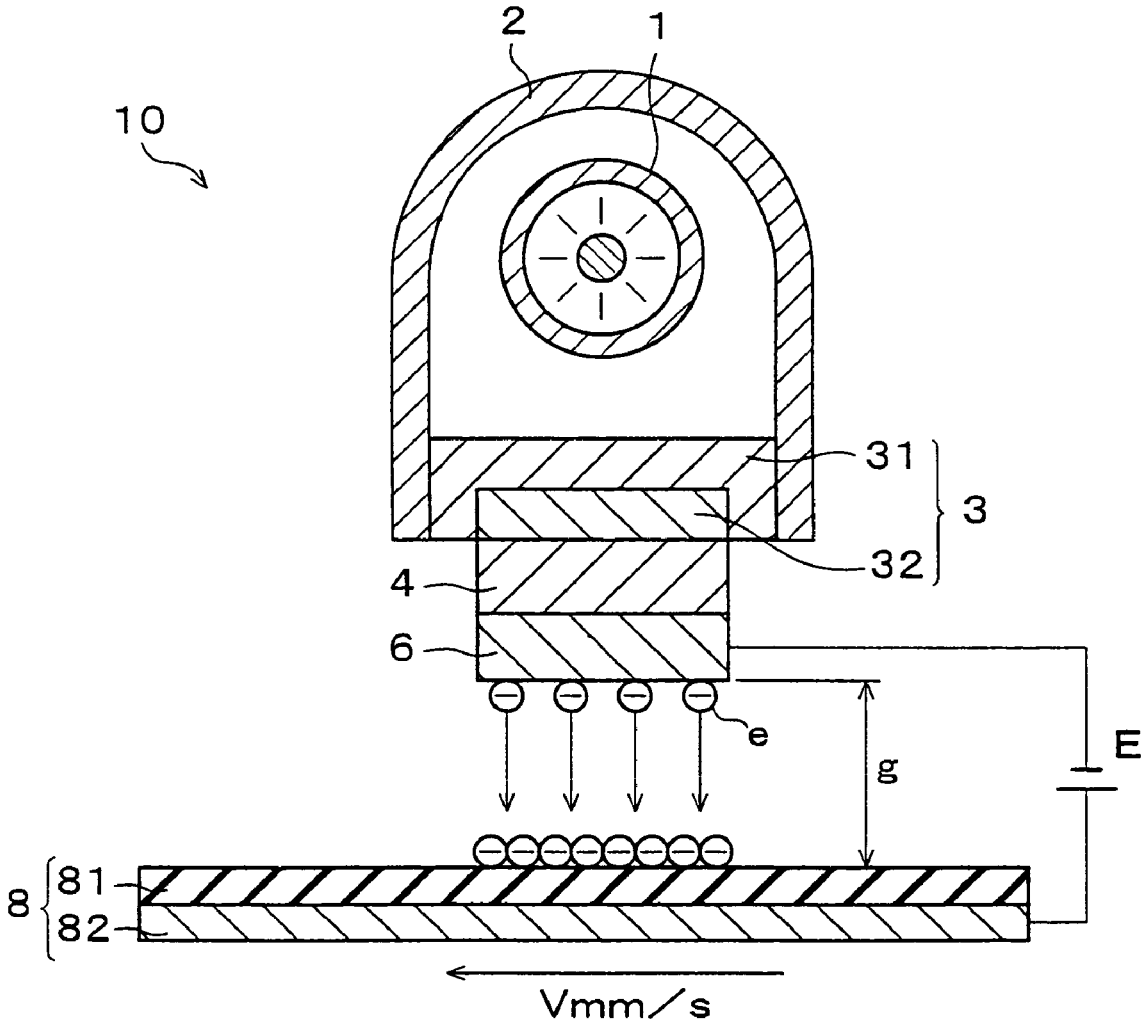
FIG. 1 is a cross-sectional view showing an arrangement example of a charging device in accordance with the present invention.

The following will explain the present invention in more detail, but the present invention is not limited to the following explanation.

First, a concept of the present embodiment will be explained. With the present arrangement, it is possible to provide a compact structure which can unify a charging step and an exposing step without generating ozone, and reduce the manufacturing cost. The basic principles of the present arrangement are to:

(1) emit electrons to charge a latent image carrying body, utilizing a so-called photoelectric effect which can converts light energy into electrical energy;

(2) control opening/closing of irradiating light on a pixel basis in order to control the emission of the electrons on a pixel basis; and (3) accelerate through an avalanche phenomenon, the electrons emitted by the photoelectric effect.

The charging device is composed of a light source; and a charging device having a laminated structure in which a liquid crystal shutter, a nonlinear optical element, and a photoelectric element are layered. The process in which an electrostatic latent image is formed on the latent image carrying body will be explained as follows.

(1) Light having a wavelength $\lambda$ (nm) is emitted from the light source, and uniformly irradiated on the charging device from the side of the liquid crystal shutter.

(2) In accordance with input image data to be transferred on a recording material, the irradiated light having the wavelength $\lambda$ is selectively transmitted by the opening/closing of the liquid crystal shutter that is divided on a pixel basis.

(3) The light having the wavelength $\lambda$, which transmitted the liquid crystal shutter, is converted to have a wavelength $\lambda/n$ by the nonlinear optical element.

(4) The converted light having the wavelength $\lambda/n$ is irradiated on the photoelectric element having a work function W, so that electrons are emitted from the photoelectric element due to the photoelectric effect.

(5) The electrons emitted from the photoelectric element are amplified utilizing the avalanche phenomenon (avalanche effect), in order to increase an amount of the emitted electrons. As a result, an electrostatic latent image having a desired surface charge density is obtained. The avalanche phenomenon is a phenomenon where electrons accelerated by the application of electrical bias, etc., collide with various molecules in the air so as to ionize the molecules. As a result, like the electrons emitted from the photoelectric element, ion and electrons derived from the molecules can charge the latent image carrying body.

For high-speed printing, in particular, the present system may be arranged as follows. By employing a liquid crystal shutter as the shutter section, the shutter section can have an improved response speed of a few $\mu$ seconds. This can increase the writing speed, thereby achieving the high-speed printing. The liquid crystal shutter can employ known arrangements.

Further, for the purpose of forming a uniform electric field in order to increase the electrons, a transparent conductive film that transmits light having a wavelength $\lambda/n$ is formed between a wavelength conversion section and the electron emission section. The transparent conductive film is used as an electrode for applying the electric field.

In order to convert the wavelength stably without fluctuation, in particular, the present system may be arranged as follows. By employing a nonlinear optical element as the wavelength conversion section, the wavelength conversion section can obtain higher harmonic wave whose wavelength does not fluctuate. This can stabilize the wavelength conversion.

In forming the laminated structure of the charging means, in particular, a material suitably used as the electron emission section may be arranged as follows. Namely, the electron emission section is thin film metal made of a material which satisfies:

$$W<n\times 1254/\lambda,$$

where W (eV) is a work function of the electron emission section, $\lambda$ (nm) is a wavelength of the light irradiated from the irradiating means, and 1/n is a conversion ratio of the wavelength conversion section.

Next, a more concrete example of the arrangement will be explained. FIG. 1 shows an arrangement of the present charging device 10. As shown in FIG. 1, a dielectric film 8 is formed on a surface of the latent image carrying body on which an electrostatic latent image is to be written. The dielectric film 8 is formed in such a manner that an aluminum base material 82 is formed on the surface of the latent image carrying body and, on the aluminum base material 82, a polyethylene terephthalate film 81 is rolled and formed into a film so as to be seen from the side of the light source 1. The dielectric film 8 moves at a speed of V=50 mm/s in a direction parallel to a metal film 6 as the electron emission section.

Above and in the vicinity of the dielectric film 8, the charging device 10 for writing an electrostatic latent image onto the dielectric film 8 is provided.

The charging device 10 is provided with the light source 1 as the light irradiating means, a reflector 2 for condensing light beam of the light source 1, and the charging means. Here, the light source 1 is assumed to irradiate light having a wavelength $\lambda$ of 508 nm at an irradiation intensity of 10 $mW/cm^2$. The charging means is arranged so that a liquid crystal shutter 3 as the shutter section, a nonlinear optical element 4 as the light wavelength converting means (wavelength conversion section), and a metal film 6 as the electron emission section are layered sequentially from the side of the light source 1.

The liquid crystal shutter 3 is composed of a substrate 31 and a liquid crystal element 32. Here, the liquid crystal shutter 3 has a pixel definition of 400 dpi.

The nonlinear optical element 4 provided on the liquid crystal shutter 3 generates second harmonic wave. Accordingly, the wavelength $\lambda$ of the light transmitted the liquid crystal shutter 3 is halved, namely, converted to $\lambda/2$. For example, if $\lambda$=508 nm as described earlier, then the wavelength is converted to 508/2=254 nm. Note that, if the light source 1 can irradiate light having a desired short wavelength, the nonlinear optical element 4 is not required.

The metal film 6 (made of gold in this example) provided on the nonlinear optical element 4 is formed to have a work function W=4.6 eV and a transmittance of 60%. Here, the photoelectric effect is generated and electrons are emitted if the following relationship is satisfied:

$$W<n\times 1254/\lambda,$$

where n is an integer not less than 1. In this example, the above relationship is satisfied with W<2×1254/508.

Figure 3:
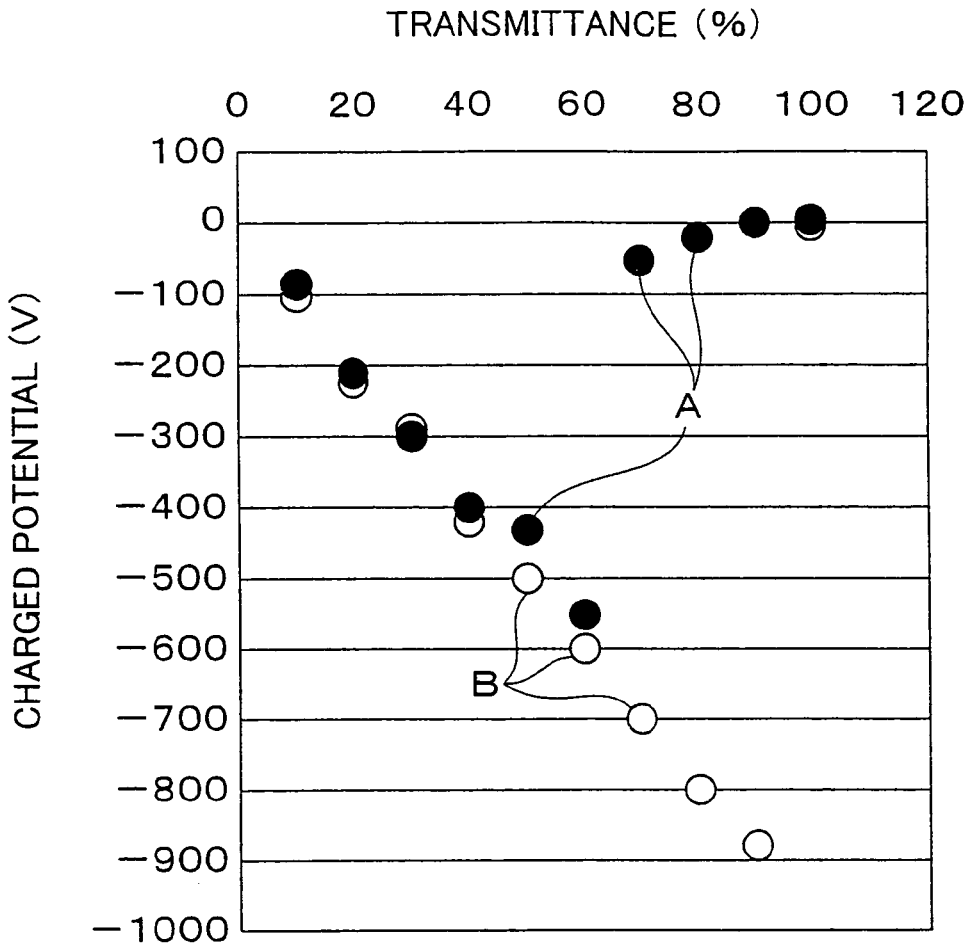
FIG. 3 is a graph showing charging characteristics of a dielectric film with respect to light transmittance of a metal film.

Further, as electrical bias means for accelerating the electrons emitted from the electron emission section and multiplying the electrons by the avalanche phenomenon, a voltage of −600 V as a voltage of a DC power source E is applied across the metal film 6 and the aluminum base material 82 of the dielectric film 8. It is assumed here that a gap g between the metal film 6 as the electron emission section and the dielectric film 8 is 100 $\mu$m. In FIG. 1, e indicates the emitted electrons. Here, as shown in FIG. 3 to be described later, the dielectric film 8 generates −500 V as a charged potential.

Figure 2:
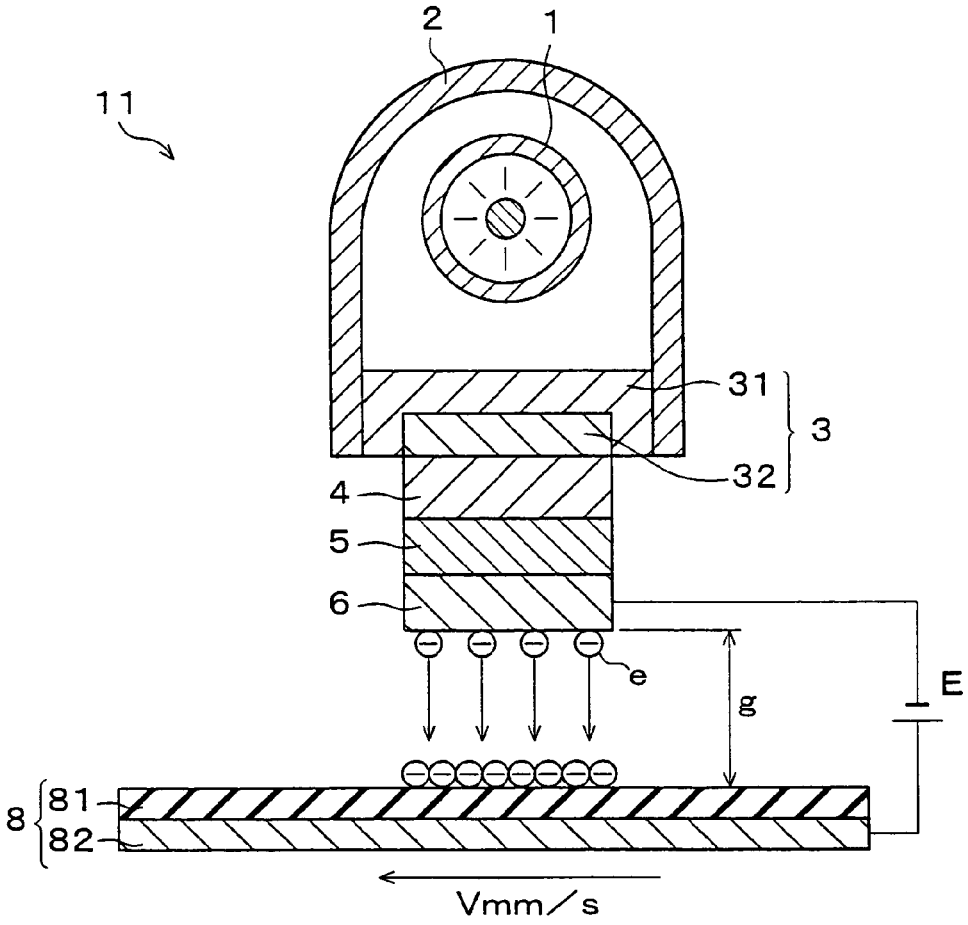
FIG. 2 is a cross-sectional view showing another arrangement example of a charging device in accordance with the present invention.

The arrangement of FIG. 1 may be modified into an arrangement shown in FIG. 2. Namely, in the foregoing arrangement, a transparent conductive film 5 is newly formed between the nonlinear optical element 4 and the metal film 6. Here, the transparent conductive film 5 may be made of $Ga_2O_3$, for example. In the arrangement shown in FIG. 1, the metal film 6 as the electron emission section emits the maximum amount of electrons when the metal film 6 has the transmittance of 60%, but the amount of emitting electrons remarkably decreases if the transmittance further increases. FIG. 3 shows results of examination on this matter. FIG. 3 shows charging characteristics, namely, the charged potential of the dielectric film 8 with respect to the light transmittance of the metal film 6. In FIG. 3, black circles A indicate results with respect to the arrangement of FIG. 1, whereas white circles B indicate results with respect to the arrangement of FIG. 2.

The reasons for the above-described remarkable decrease in the amount of emitted electrons with respect to a transmittance of not less than a predetermined value (60% in this example) are presumably as follows. Namely, in the example shown in FIG. 1, as the electrical bias means for multiplying the electrons emitted from the electron emission section, the DC voltage E=−600 V is applied across the metal film 6 and the aluminum base material 82 of the dielectric film 8, where the gap g is 100 $\mu$m between the metal film 6 and the dielectric film 8. If the transmittance of the metal film 6 exceeds a certain value (60% in this example), the metal film 6 becomes too thin below its limit. As a result, the metal film 6 has uneven conductivity, and cannot form an electric field uniformly. This prevents the charged potential of the dielectric film 8 from rising to a desired value. Note that, going downward in FIG. 3 indicates here as an "increase in a potential."

In contrast, the arrangement example of FIG. 2 uses as the electrode of the electrical bias means, not only the metal film 6 but also the transparent conductive film 5 formed on the metal film 6. With this, it is possible to appropriately raise the charged potential of the dielectric film 6 even if the metal film 6 has a very high transmittance of, for example, 90%.

As a result, it is possible to obtain a larger amount of emitted electrons, thereby performing printing in higher speed.

As described above, the present system is so arranged that the shutter section, which can be controlled to open/close on a pixel basis in accordance with image data, selectively transmits light irradiated from an entire surface of the light irradiating means; the wavelength conversion section converts the selectively transmitted light to have a desired wavelength and irradiates the converted light on the electron emission section; and the electron emission section induces and emit electrons therein so as to directly form an electrostatic latent image on the latent image carrying body. With this, it is possible to provide an electrostatic latent image generating apparatus, as well as a developing apparatus, composed of a compact structure which can unify the charging step and exposing step without generating ozone, while reducing the manufacturing cost.

Next, as a variation of the arrangement of FIG. 1 or 2, a light source (data light irradiating means; not shown) which irradiates light in accordance with image data may be further provided next to the charging device 10 or 11 on the downstream side of the moving path of the dielectric film 8. In this case, the liquid crystal shutter 3 is kept fully open irrespective of image data. Here, the metal film 6 is uniformly (evenly) irradiated by the light from the light source 1 as the light irradiating means in the charging device 10 or 11, so that a corresponding portion of the dielectric film 8 is uniformly charged. Following this, the dielectric film 8 moves. With this, the dielectric film 8 is irradiated by the data light irradiating means in accordance with the image data so as to form an electrostatic latent image in accordance with the image data. With this, it is possible to provide a charging device which does not generate ozone. In this case, the liquid crystal shutter 3 may be omitted. Note that, in this case, the dielectric film 8 needs to have photosensitivity. The data light irradiating means exposes the dielectric film 8 in accordance with image data in the following manner, for example. The light source (not shown) for irradiating data light is arranged to uniformly (evenly) irradiate light, and a liquid crystal shutter having a function similar to that used in the examples of FIGS. 1 and 2 is provided between the light source and a portion of the dielectric film 8 to be exposed. Then, the liquid crystal shutter controls transmission of the light in accordance with the image data.

Note that, a charging device of the present invention which is used in an electrophotographic apparatus and which writes an electrostatic latent image directly on a latent image carrying body is arranged so as to include light irradiating means; charging means having (i) a shutter section for controlling opening and closing of transmission of light irradiated from an entire surface of the light irradiating means, (ii) a wavelength conversion section for converting a wavelength of the light transmitted the shutter section, and (iii) an electron emission section inducing and emitting electrons therein when irradiated by the light whose wavelength has been converted by the wavelength conversion section, the shutter section, the wavelength conversion section, and the electron emission section being layered sequentially in this order; and electrical bias means for multiplying the electrons emitted from the electron emission section.

Further, the charging device of the present invention may be arranged so that the shutter section is a liquid crystal shutter element arranged on a pixel basis.

The charging device of the present invention may be arranged so that the light wavelength conversion section is a nonlinear optical element.

The charging device of the present invention may be arranged so that the electron emission section is a metal film made of a material which satisfies:

$$W<n\times 1254/\lambda,$$

where W (eV) is a work function of the electron emission section, λ (nm) is a wavelength of the light irradiated from the irradiating means, and 1/n is a conversion ratio of the wavelength converting means.

The charging device of the present invention may be arranged so as to further include a transparent conductive film between the wavelength converting means and the electron emission section, the transparent conductive film transmitting light having a wavelength of λ/n.

Further, a charging method in the charging device of the present invention which is used in an electrophotographic apparatus and which writes an electrostatic latent image directly on the latent image carrying body may be arranged so that the shutter section, which can be controlled to open and close on a pixel basis in accordance with image data, selectively transmits the light irradiated from the entire surface of the light irradiating means; the wavelength conversion section converts the selectively transmitting light to have a predetermined wavelength and irradiates the converted light to the electron emission section; and the electron emission section emits electrons therein so as to form an electrostatic latent image directly on the latent image carrying body.

With this arrangement, the shutter section, which can be controlled to open/close on a pixel basis in accordance with image data, can selectively transmit the light irradiated from the entire surface of the light irradiating means; the wavelength conversion section can convert the selectively transmitted light to have a desired wavelength and irradiate the converted light on the electron emission section; and the electron emission section can induce and emit electrons therein so as to form an electrostatic latent image directly on the latent image carrying body. With this, it is possible to provide a compact structure which can unify the charging step and exposing step without generating ozone, while reducing the manufacturing cost.

The charging device of the present invention may be arranged so that a light latent image is formed on the electron emission section when light in accordance with image data is irradiated on a photoelectron emitting surface of the electron emission section; and in accordance with the image data, the latent image carrying body is charged using the electrons emitted from the electron emission section.

With this arrangement, the charging device forms a light latent image on the electron emission section by irradiating on the surface for emitting photoelectrons, light in accordance with image data. Then, the electron emission section, which charges the latent image carrying body in accordance with the image data using the electrons emitted from the electron emission section, charges the latent image carrying body through the photoelectric effect.

Therefore, a single device can function as both an apparatus for uniform charging and an apparatus for light controlling in accordance with image data. With this, in addition to the effects of the foregoing arrangements, it is possible to miniaturize the device without causing the problem of environmental pollution due to ozone.

The latent image carrying body needs not be a photosensitive body, and may be made of any material having an electrostatic property, i.e., any dielectric (insulator). The latent image carrying body may be, but not limited to, glass, alumina, silicon, and polyester.

In this arrangement, the light irradiating means may be arranged to uniformly (evenly) irradiate light toward the electron emission section. In this case, shutter means may be provided between the light irradiating means and the electron emission section so as to control the irradiation of the light onto the electron emission section. In this case, liquid crystal shutter means may be arranged to control the irradiation of the light.

Further, instead of appropriately shutting the uniformly irradiated light by the shutter, the charging device may be arranged so that, in accordance with the image data, the light irradiating means increases or decreases the light to be irradiated toward the electron emission section.

Further, the charging device of the present invention is arranged so as to further include data light irradiating means irradiating on the latent image carrying body, light in accordance with image data, the latent image carrying body being a photosensitive body, the electron emission section uniformly charging the latent image carrying body through the photoelectric effect, the data light irradiating means forming an electrostatic latent image on the latent image carrying body by irradiating on the latent image carrying body, the light in accordance with the image data.

With this arrangement, the light uniformly irradiated from the light irradiating means uniformly (evenly) charges the latent image carrying body by the photoelectric effect. Next, the light irradiation of the data light irradiating means is controlled to form an electrostatic latent image. Namely, the data light irradiating means irradiates on the latent image carrying body, the light in accordance with the image data, and then erases electrons on the latent image carrying body only at a portion where the light impinges on the latent image carrying body, thereby forming an electrostatic latent image on the latent image carrying body. With this, in addition to the effects of the foregoing arrangements, it is possible to uniformly charge the latent image carrying body using the element which generates the electrostatic effect.

In this arrangement, the data light irradiating means may be arranged to uniformly (evenly) irradiate light toward the latent image carrying body. In this case, shutter means may be provided between the data light irradiating means and the latent image carrying body so as to control the irradiation of the light onto the latent image carrying body. In this case, liquid crystal shutter means may be arranged to control the light irradiation.

Further, instead of appropriately shutting the uniformly irradiated light by the shutter, the charging device may be arranged so that, in accordance with the image data, the light irradiating means increases or decreases the light to be irradiated toward the electron emission section.

The charging device of the present invention may be arranged so as to further include light wavelength converting means converting a wavelength of the light irradiated from the light irradiating means.

This arrangement converts the wavelength of the light irradiated from the light irradiating means. With this, it is possible to obtain light having a desired wavelength irrespective of the wavelength of the light irradiated from the light irradiating means. Therefore, in addition to the effects of the foregoing arrangements, it is possible to use a broader variety of light sources as the light irradiating means.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

INDUSTRIAL APPLICABILITY

The present invention relates to a charging device in an image forming apparatus employing an electrophotographic system, and can be used particularly for a copying machine, printer, facsimile machine, and the like.

What is claimed is:

1. A charging device for use in a developing apparatus which forms an electrostatic latent image on a latent image carrying body and develops an image using a developing agent, said charging device comprising:

light irradiating means for irradiating light; and an electron emission section charging said latent image carrying body by, upon receiving the light irradiated from said light irradiating means, emitting electrons through a photoelectric effect.

2. The charging device as set forth in claim 1, wherein:

a light latent image is formed on said electron emission section when light in accordance with image data is irradiated on a photoelectron emitting surface of said electron emission section; and in accordance with the image data, said latent image carrying body is charged using the electrons emitted from said electron emission section.

3. The charging device as set forth in claim 1, further comprising:

data light irradiating means irradiating on said latent image carrying body, light in accordance with image data, said latent image carrying body being a photosensitive body, said electron emission section uniformly charging said latent image carrying body through the photoelectric effect, said data light irradiating means forming an electrostatic latent image on said latent image carrying body by irradiating on said latent image carrying body, the light in accordance with the image data.

4. The charging device as set forth in any one of claims 1 through 3, further comprising:

light wavelength converting means converting a wavelength of the light irradiated from said light irradiating means.

5. The charging device as set forth in claim 4, wherein:

said light wavelength converting means is a nonlinear optical element.

6. The charging device as set forth in claim 5, wherein:

said electron emission section is a metal film made of a material which satisfies:

$$W<n\times 1254/\lambda,$$

where W (eV) is a work function of said electron emission section, λ (nm) is a wavelength of the light irradiated from said light irradiating means, and 1/n is a conversion ratio of said light wavelength converting means.

7. The charging device as set forth in claim 4, wherein:

said electron emission section is a metal film made of a material which satisfies:

$$W<n\times 1254/\lambda,$$

where W (eV) is a work function of said electron emission section, λ (nm) is a wavelength of the light irradiated from said light irradiating means, and 1/n is a conversion ratio of said light wavelength converting means.

8. The charging device as set forth in claim 7, further comprising:

a transparent conductive film between said light wavelength converting means and said electron emission section, said transparent conductive film transmitting light having a wavelength of $\lambda/n$, wherein:

$\lambda$ (nm) is a wavelength of the light irradiated from said light irradiating means, and 1/n is a conversion ratio of said light wavelength converting means.

9. The charging device as set forth in any one of claims 1 through 3, further comprising:

electrical bias means for multiplying the electrons emitted from said electron emission section.

10. The charging device as set forth in any one of claims 1 through 3, further comprising:

a shutter section for controlling opening and closing of transmission of the light irradiated from an entire surface of said light irradiating means.

11. The charging device as set forth in claim 10, wherein:

said shutter section is a liquid crystal shutter element arranged on a pixel basis.

12. The charging device as set forth in claim 1, wherein:

the electron emission section emits electrons through a surface photoelectric effect.

13. The charging device as set forth in claim 1, wherein:

the electron emission section emits photoelectrons from a photoelectron emitting surface of the electron emission section through a photoelectric effect.

* * * * *

UNITED STATES PATENT AND TRADEMARK OFFICE

CERTIFICATE OF CORRECTION

PATENT NO. : 7,015,938 B2
APPLICATION NO. : 10/502201
DATED : March 21, 2006
INVENTOR(S) : Taisuke Kamimura et al.

It is certified that error appears in the above-identified patent and that said Letters Patent is hereby corrected as shown below:

Title page,

Item [86], PCT Pub. No., please change "WO02/058130" to --WO03/065127--

Item [86], PCT Pub. Date, please change "Jul. 25, 2002" to --Aug. 7, 2003--

Signed and Sealed this

First Day of May, 2007

JON W. DUDAS
*Director of the United States Patent and Trademark Office*